US006500196B2

(12) United States Patent
Shattles

(10) Patent No.: US 6,500,196 B2
(45) Date of Patent: Dec. 31, 2002

(54) PACIFIER WRIST TETHER

(76) Inventor: Casandra A. Shattles, 13927 Wickersham La., Houston, TX (US) 77077

( * ) Notice: Subject to any disclaimer, the term of this patent is extended or adjusted under 35 U.S.C. 154(b) by 89 days.

(21) Appl. No.: 09/746,863

(22) Filed: Dec. 21, 2000

(65) Prior Publication Data

US 2002/0082642 A1 Jun. 27, 2002

(51) Int. Cl.[7] ..... A61J 17/00
(52) U.S. Cl. ..... 606/234; 2/160
(58) Field of Search ..... 606/234, 235, 606/236; 24/301, 302; 2/160, 161.2, 161.5

(56) References Cited

U.S. PATENT DOCUMENTS 2,447,328 A * 8/1948 Gerrits ..... 2/16
2,688,961 A * 9/1954 Thomas ..... 128/880
2,709,257 A * 5/1955 McKinney ..... 2/16
2,798,482 A * 7/1957 Feeney ..... 128/880
4,277,910 A 7/1981 Kramer
5,123,674 A * 6/1992 Bagneres et al. ..... 2/160
5,147,384 A 9/1992 La Rocca
D331,287 S 11/1992 Smith
D337,385 S 7/1993 Lussier
5,335,916 A * 8/1994 Nee ..... 2/161.1
5,391,184 A 2/1995 Rosenthal
5,497,510 A * 3/1996 Knowles et al. ..... 2/159
5,522,849 A 6/1996 Xiques et al.
5,538,501 A * 7/1996 Caswell ..... 128/878
D380,268 S 6/1997 Krause et al.
D402,760 S 12/1998 Kline
5,864,884 A * 2/1999 Salvitti ..... 2/159
D415,837 S 10/1999 Williams
5,993,285 A 11/1999 Sofia et al.
5,997,039 A * 12/1999 Manninen ..... 2/160

* cited by examiner

*Primary Examiner*—Danny Worrell
(74) *Attorney, Agent, or Firm*—Dale J. Ream

(57) ABSTRACT

A wrist tether for use in conjunction with a pacifier comprises a wristband having hook and loop fasteners arranged such that the wristband may be wrapped about an infant's wrist and removably secured thereto. A thumb support is attached to an end of the wristband and defines an aperture for receiving a thumb of a user so as to position the wristband at a desired position. The thumb support further defines a buttonhole spaced from the aperture for receiving a retaining member within a cavity therein. Therefore, the pacifier wrist tether removably positions and holds a pacifier at a desired position adjacent an infant's thumb.

13 Claims, 6 Drawing Sheets

PACIFIER WRIST TETHER

BACKGROUND OF THE INVENTION

This invention relates generally to pacifier devices for infants and, more particularly, to a pacifier wrist tether for removably positioning and holding a pacifier at a desired position adjacent an infant's thumb.

Most infants and many toddlers desire to suck on a pacifier. Frequently, however, these children often substitute one of their thumbs for a pacifier, especially when a pacifier is not available. Eventually, this thumb-sucking becomes a habitual practice that is undesirable to many parents for a variety of reasons. A particular problem with pacifiers is that they become lost or dirty when they fall from the infant's mouth. A related problem is when parents attempt to retrieve a fallen pacifier while driving.

Various devices have been proposed in the art for positioning a pacifier upon an infant's wrist using a strap. Although assumably effective for their intended purposes, these devices do not provide means for maintaining a pacifier at a particular position adjacent an infant's thumb or to removably hold a pacifier.

Therefore, it is desirable to have a pacifier wrist tether which may be wrapped about an infant's wrist and held in a desired position with a thumb support. Further, it is desirable to have a pacifier wrist tether from which a pacifier may be selectively removed.

SUMMARY OF THE INVENTION

A pacifier wrist tether according to the present invention includes a wristband having hook and loop fasteners disposed adjacent opposed ends and on opposed sides thereof such that the wristband may be wrapped about an infant's wrist and removably held thereon by engagement of the fasteners. A thumb support is attached to one end of the wristband and defines an aperture for receiving an infant's thumb therethrough. The thumb support aperture allows the wristband to be maintained at a consistent and desired position. One side of the thumb support also defines a buttonhole in communication with an interior cavity. The buttonhole and cavity are configured to receive the retaining member of a pacifier. A particular pacifier may be used having a button-like retaining member that is particularly adapted to be removably held within the cavity.

Therefore, a general object of this invention is to provide a wrist tether which removably holds a pacifier on the wrist of an infant.

Another object of this invention is to provide a wrist tether, as aforesaid, having a thumb support for holding the pacifier at a position adjacent an infant's own thumb.

Still another object of this invention is to provide a wrist tether, as aforesaid, having a button-like configuration for removably holding a pacifier.

A further object of this invention is to provide a wrist tether, as aforesaid, in which the nipple member of the pacifier may be pivotal relative to the retaining member.

A still further object of this invention is to provide a wrist tether, as aforesaid, which enhances physiological and neural behavioral organization by an infant relative to sighting, moving, and positioning a pacifier in his or her mouth.

Another object of this invention is to provide a wrist tether, as aforesaid, that is washable.

Still another object of this invention is to provide a wrist tether, as aforesaid, which inhibits an infant from sucking his thumb.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 4A:
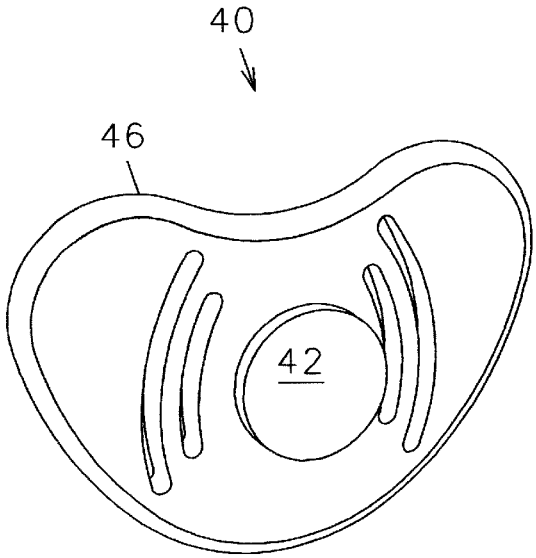
FIG. 4A is a rear perspective view of the pacifier as in FIG. 2.
Figure 4B:
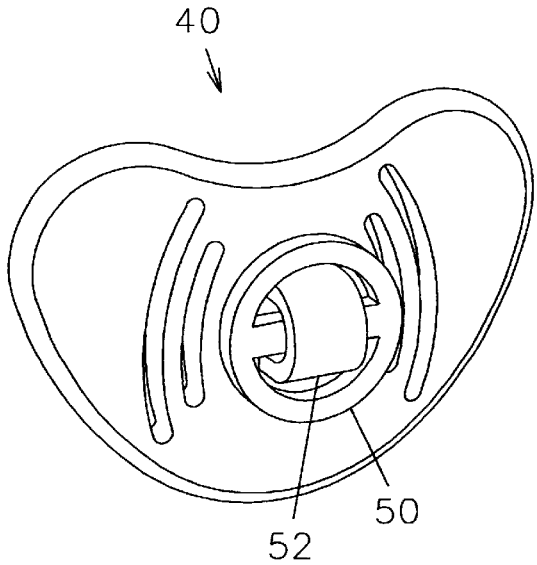
FIG. 4B is a rear perspective view of another embodiment of the pacifier.
Figure 5A:
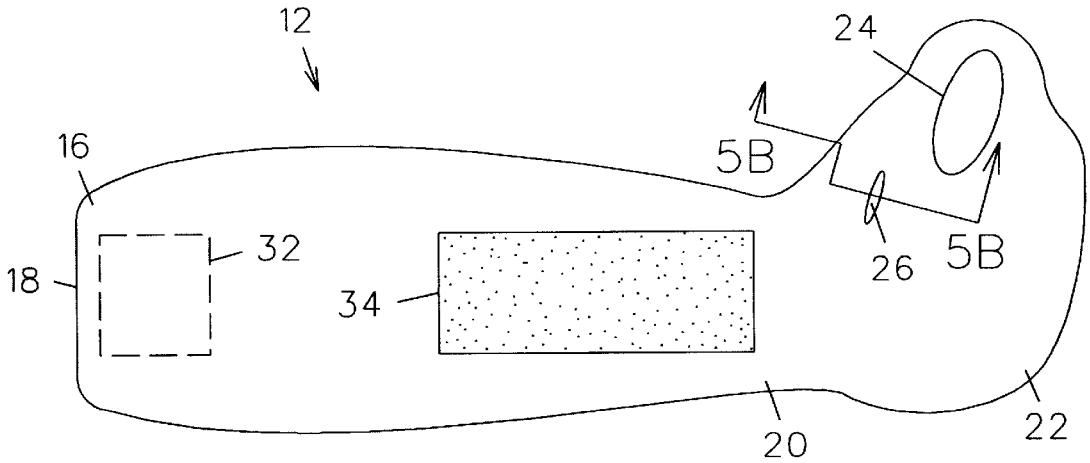
FIG. 5A is a top view of a wrist tether as in FIG. 1 removed from an infant's wrist.
Figure 5B:
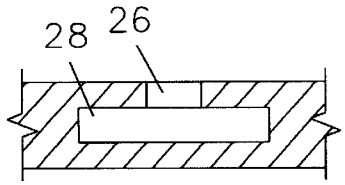
FIG. 5B is a sectional view taken along line 5B—5B of FIG. 5A.
Figure 5C:
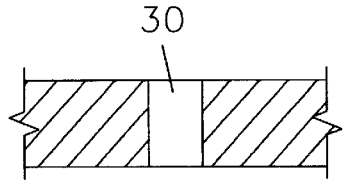
FIG. 5C is a sectional view of another embodiment of the wrist tether as in FIG. 5A taken along line 5B—5B thereof.

A pacifier wrist tether according to the present invention will now be described with reference to FIGS. 1–6B of the accompanying drawings. A pacifier wrist tether 10 according to one embodiment includes a generally rectangular wristband 12 configured so as to retain a pacifier 40. The wristband 12 includes a fabric strip extending longitudinally between opposed ends. The wristband 12 includes inner (not shown) and outer 14 surfaces. A first free end 16 presents a lateral edge 18 (FIG. 5A). The wristband 12 presents a length sufficient to wrap around an infant's wrist with a portion of the inner surface along the lateral edge 18 overlapping a portion of the outer surface 14. A thumb support 22 is integrally attached to the second end 20. The thumb support 22 is constructed of fabric layers and defines first 24 and second 26 spaced apart apertures. The first aperture 24 includes a diameter larger than a diameter of the second aperture 26 and is configured to receive a user's thumb and, more particularly, an infant's thumb. The second aperture 26 is a slit in the outer surface of the thumb support 22 and is configured to receive a retaining member 42 of a pacifier 40. The second aperture 26 communicates with a cavity 28 defined between two layers of the thumb support 22 (FIG. 5B). The retaining member 42 of a pacifier 40 includes a round, button-like configuration that is removably held within the cavity 28 when inserted through the second aperture 26. Therefore, the second aperture 26 operates as a buttonhole. The pacifier 40 configuration will be described more fully below. Alternatively, the second aperture 26 may communicate with a bore 30 that extends entirely between upper and lower surfaces of the thumb support 22 (FIG. 5C). In this embodiment, a retaining member 42 is held against the inner surface of the wristband 12 after being inserted through the second aperture 26 and bore 30.

A plurality of hook fasteners 32, such as VELCRO, are disposed on the inner surface of the wristband 12 adjacent the lateral edge 18 of the first end 16. The hook fasteners 32 are shown with phantom lines in FIG. 5A to indicate their position on the inner surface of the wristband 12. The hook fasteners 32 include a generally square arrangement although other configurations would also work. A plurality of loop fasteners 34 are disposed on the outer surface 14 of the wristband 12 in a generally rectangular configuration. The fasteners are arranged such that the hook fasteners 32 engage the loop fasteners 34 when the wristband 12 is wrapped about a user's wrist. Further, the hook fasteners 32 may be positioned to engage the loop fasteners 34 at various points along the longitudinal extent of the loop fasteners 34 so as to vary the tightness of the wristband 12 about the user's wrist.

Figure 1:
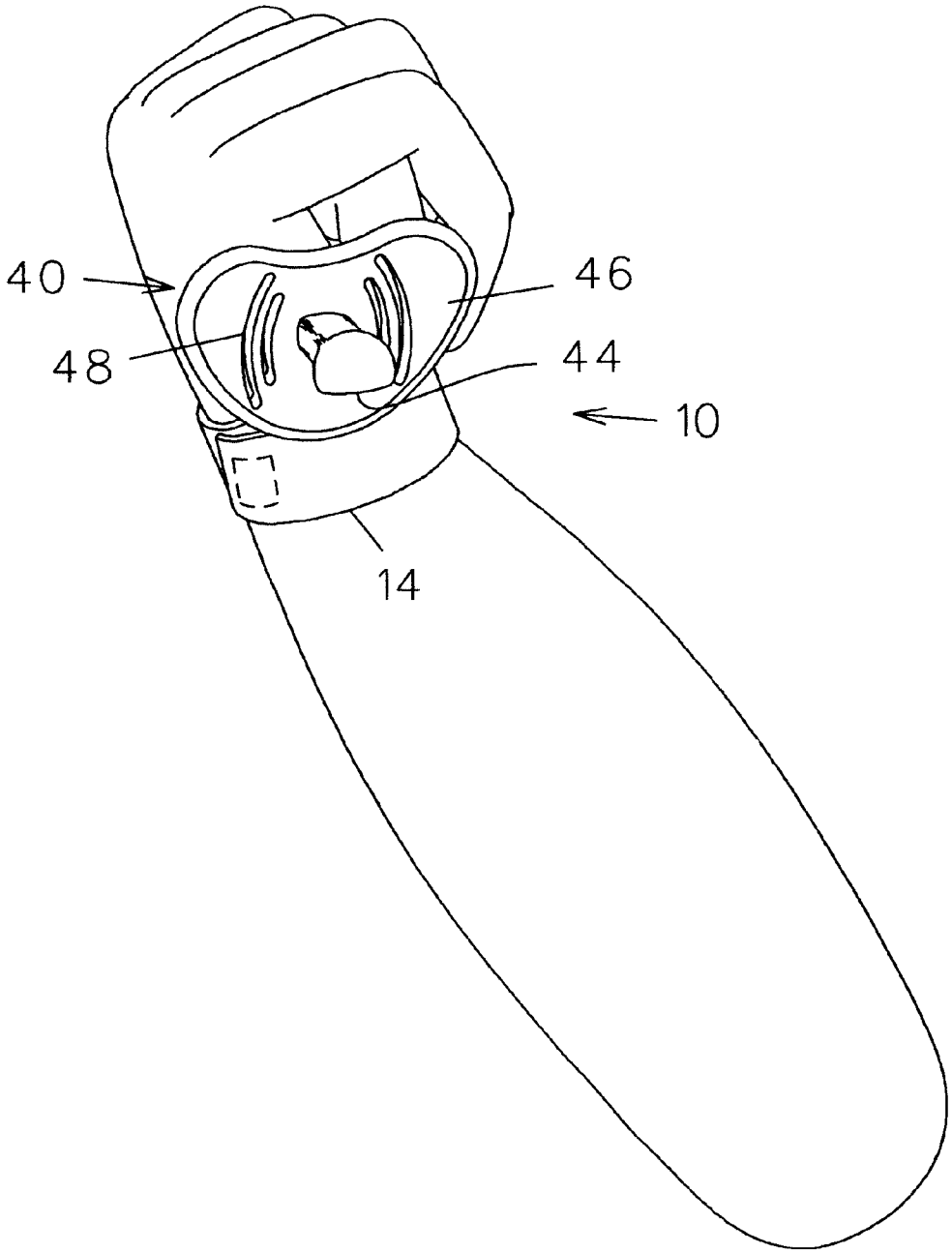
FIG. 1 is a perspective view of a pacifier wrist tether according to the present invention in use upon an infant's wrist.
Figure 2:
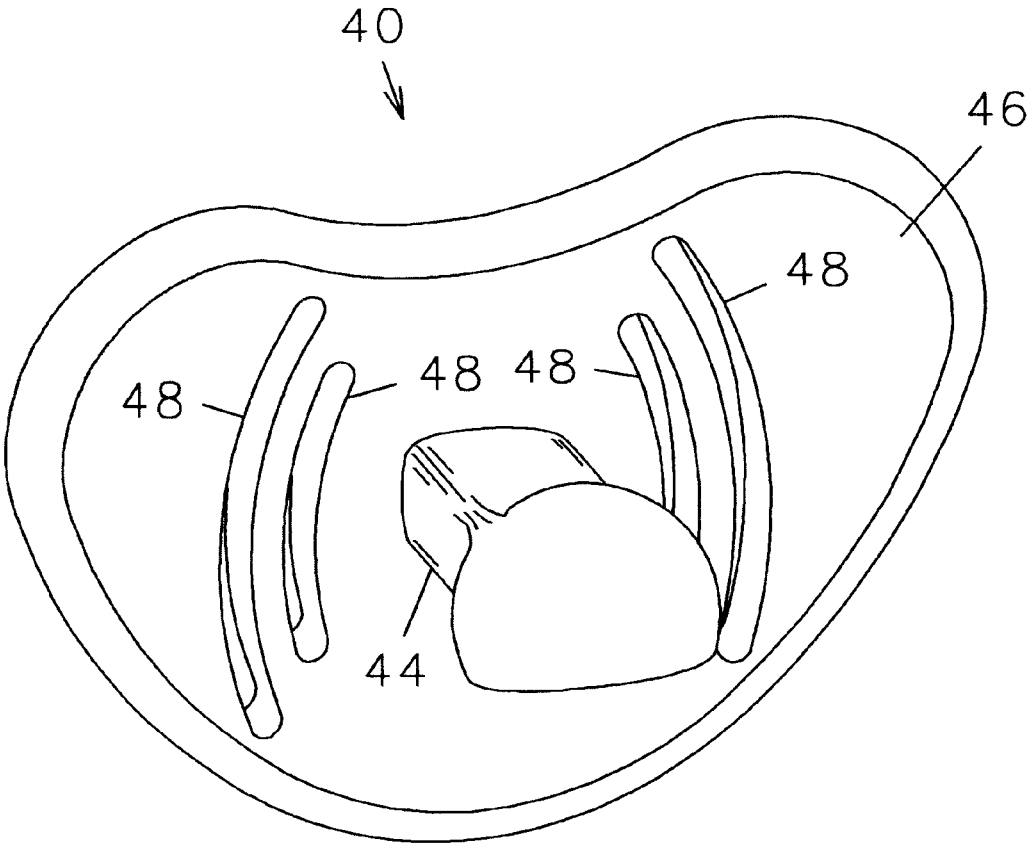
FIG. 2 is a perspective view of a pacifier according to the present invention.
Figure 3A:
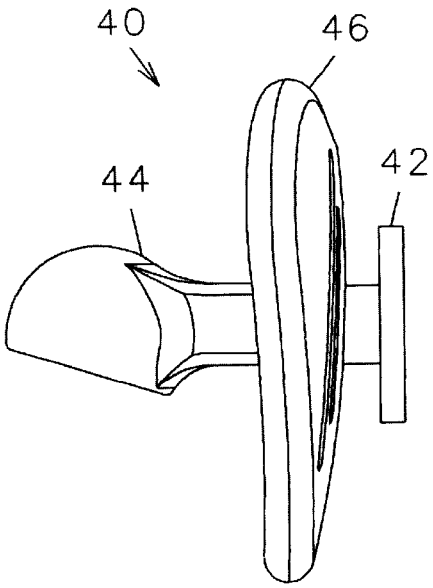
FIG. 3A is a side view of the pacifier as in FIG. 2.
Figure 3B:
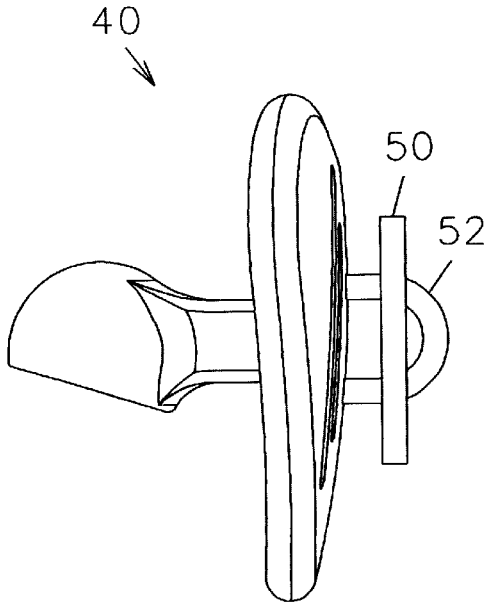
FIG. 3B is a side view of another embodiment of the pacifier.

The second aperture 26 is sized to receive the retaining member of a conventional pacifier. Preferably, however, a pacifier 40 having a slightly modified design is included in the present invention and includes a retaining member 42 and a nipple member 44 (FIG. 3A) with an annular flange 46 disposed therebetween, the flange 46 defining slits 48 for efficient air flow therethrough (FIG. 2). Preferably, the retaining member 42 includes a circular, button-like configuration for insertion through the second aperture 26 (FIGS. 3A and 4A). The retaining member 42 and cavity 28 present complementary configurations and dimensions such that the retaining member 42 is removably held therein. Alternatively, the button-like retaining member 50 may be pivotally mounted upon a U-shaped bracket 52 such that the nipple member 44 is vertically pivotal when the retaining member 50 is held within the thumb support cavity 28 (FIGS. 3B and 4B).

Figure 6A:
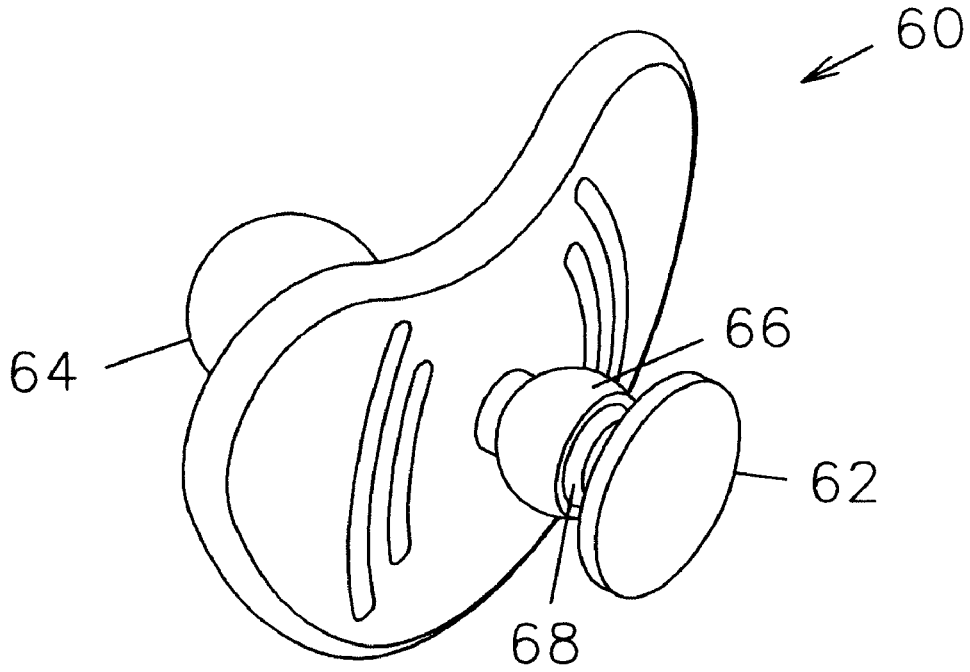
FIG. 6A is a rear perspective view of another embodiment of the pacifier.
Figure 6B:
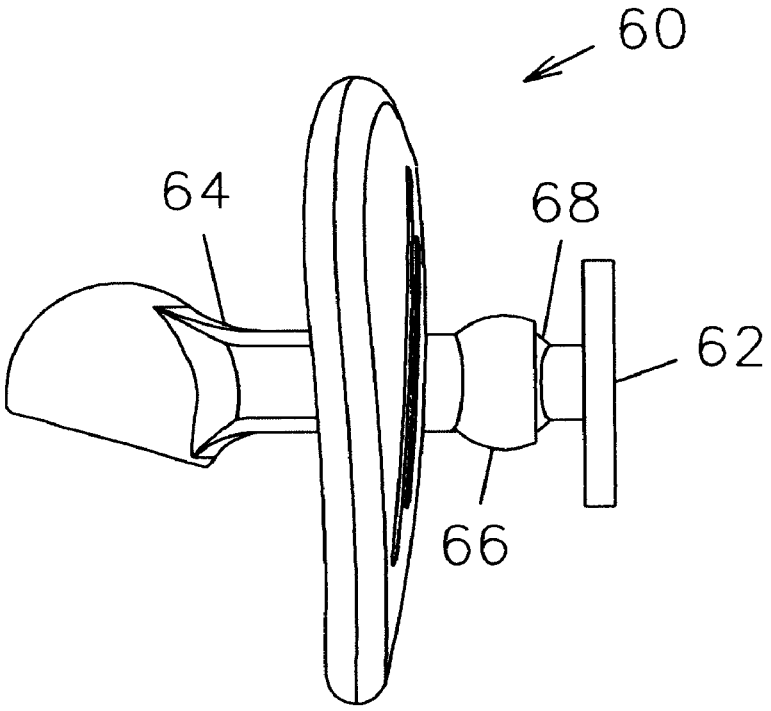
FIG. 6B is a side view of the pacifier as in FIG. 6A.

Another embodiment of the pacifier 60 is very similar to the pacifier 40 described above except that the retaining member 62 is pivotally coupled to the nipple member 64 in a ball and socket arrangement (FIGS. 6A and 6B). More particularly, a socket 66 is fixedly attached to a rear end of the nipple member 64 and a ball 68 is fixedly attached to the retaining member 62. The ball 68 and socket 66 are dimensioned to engage one another to allow 180 degree pivotal movement of the nipple member 64 relative to the retaining member 62.

In use, the wristband 12 of the pacifier wrist tether 10 is wrapped about the wrist of an infant such that a thumb of the infant is extended through the first aperture 24 and such that the lateral edge 18 overlaps a portion of the outer surface 14 of the wristband 12. The hook 32 and loop 34 fasteners engage one another in this wrapped configuration so as to securely hold the wristband 12 about the wrist while the thumb support 22 maintains the desired wristband position. The retaining member 42 of the pacifier 40 is removably inserted through the second aperture 26 into the cavity 28. In this configuration, the nipple member 44 extends outwardly away from the wristband 12 and is adjacent an infant's thumb. Therefore, an infant may suck on the nipple member 44 which will remain secured to the wristband 12 even after use. The wristband 12 may be unwrapped from the infant's wrist and the pacifier removed therefrom as desired by an adult, e.g. for washing or storage.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A wrist tether for use in conjunction with a pacifier having a nipple member and an opposed retaining member, comprising:

a wristband adapted to removably encircle a wrist of a user;

a thumb support extending from said wristband and adapted to receive a user's thumb, a reception of said thumb in said thumb support positioning said wristband at a desired position on a wrist of the user;

said thumb support adapted to receive said retaining member of said pacifier such that said nipple member is positioned adjacent a user's thumb when said wristband is in use;

wherein said thumb support defines a first aperture adapted to receive a user's thumb and a buttonhole spaced from said first aperture adapted to receive said retaining member therein; and wherein said thumb support defines a bore between upper and lower surfaces thereof, said bore being in communication with said buttonhole.

2. The wrist tether as in claim 1 wherein said wristband includes a first end having a lateral edge and a second end attached to said thumb support opposite said first end, said wristband having an inner surface and an outer surface and defining a length sufficient to wrap around a child's wrist with a portion of said inner surface along said lateral edge thereof overlapping a portion of said outer surface.

3. The wrist tether as in claim 2 further comprising a plurality of hook fasteners disposed on said inner surface of said wristband adjacent said lateral edge and a plurality of loop fasteners disposed on said outer surface adjacent said second end, said hook and loop fasteners being configured so as to engage one another when said wristband is wrapped about a user's wrist to securely maintain said wristband thereon.

4. The wrist tether as in claim 3 wherein said loop fasteners are arranged in a rectangular configuration and said hook fasteners are arranged in a square configuration adapted to engage said loop fasteners at selected longitudinal positions therealong, whereby to adjust the tightness of said wristband about a user's wrist.

5. The wrist tether as in claim 1 wherein said thumb support defines a cavity in communication with said buttonhole adapted to removably retain said retaining member of said pacifier when said retaining member is inserted through said button bole.

6. A pacifier wrist tether, comprising:

a wristband having a first end and a second end and adapted to selectively encircle a wrist of a user;

a pacifier having a nipple member at one end and a retaining member at an opposed end;

a thumb support extending from said second end of said wristband and defining a first aperture adapted to receive a user's thumb and a second aperture spaced from said first aperture adapted to receive said retaining member, a reception of said thumb in said first aperture positioning said wristband at a desired position about a wrist of the user and a reception of said retaining member in said second aperture causing said nipple member to extend away from said thumb support.

7. The pacifier wrist tether as in claim 6 wherein said first end of said wristband includes a lateral edge, said wristband having an inner surface and an outer surface and defining a length sufficient to wrap around a child's wrist with a portion of said inner surface along said lateral edge thereof overlapping a portion of said outer surface.

8. The pacifier wrist tether as in claim 7 further comprising a plurality of hook fasteners disposed on said inner surface of said wristband adjacent said lateral edge and a plurality of loop fasteners disposed on said outer surface adjacent said second end, said hook and loop fasteners being configured so as to engage one another when said wristband is wrapped about a user's wrist to securely maintain said wristband thereon.

9. The pacifier wrist tether as in claim 6 wherein said thumb support defines a cavity in communication with said second aperture adapted to removably retain said retaining member of said pacifier when said retaining member is inserted through said second aperture.

10. The pacifier wrist tether as in claim 6 wherein said pacifier includes an annular flange intermediate said nipple member and said retaining member, said annular flange defining a plurality of slits therethrough.

11. The pacifier wrist tether as in claim 6 wherein said retaining member of said pacifier is fixedly attached to said nipple member and includes a circular configuration having dimensions complementary to said buttonhole for slidable insertion therein or removal therefrom.

12. The pacifier wrist tether as in claim 6 wherein said retaining member of said pacifier is pivotally coupled to said nipple member such that said nipple member is movable by a user when said retaining member is positioned in said second aperture.

13. A pacifier wrist tether, comprising:

an elongate wristband having a first end and a second end and adapted to selectively encircle a wrist of a user, said wristband having an inner surface and an outer surface and defining a length sufficient to wrap around a user's wrist with a portion of said inner surface adjacent said first end overlapping a portion of said outer surface;

a plurality of hook fasteners disposed on said inner surface of said wristband adjacent said first end;

a plurality of loop fasteners disposed on said outer surface adjacent said second end, said hook and loop fasteners being configured so as to engage one another when said wristband is wrapped about a user's wrist so as to securely maintain said wristband thereon;

a pacifier having a nipple member at one end and a retaining member at an opposed end;

a thumb support extending from said second end of said wristband and defining a first aperture adapted to receive a user's thumb and a buttonhole spaced from said first aperture adapted to receive said retaining member, a reception of said thumb in said first aperture positioning said wristband at a desired position about a wrist of the user and a reception of said retaining member in said buttonhole causing said nipple member to extend away from said thumb support.

* * * * *